US006287031B1

(12) United States Patent
Willis

(10) Patent No.: US 6,287,031 B1
(45) Date of Patent: Sep. 11, 2001

(54) PRINTING APPARATUS

(75) Inventor: Michael B Willis, Cambridge (GB)

(73) Assignee: Ascom Hasler Mailing Systems, Inc., Shelton, CT (US)

( * ) Notice: Subject to any disclaimer, the term of this patent is extended or adjusted under 35 U.S.C. 154(b) by 0 days.

(21) Appl. No.: 09/000,194

(22) PCT Filed: May 29, 1997

(86) PCT No.: PCT/US97/09340

§ 371 Date: May 15, 1998

§ 102(e) Date: May 15, 1998

(87) PCT Pub. No.: WO97/46389

PCT Pub. Date: Dec. 11, 1997

Related U.S. Application Data

(60) Provisional application No. 60/019,087, filed on Jun. 3, 1996.

(51) Int. Cl.[7] ..... B41J 11/26

(52) U.S. Cl. ..... 400/621; 101/483; 101/227; 156/378; 156/384; 347/4; 347/105

(58) Field of Search ..... 400/621, 208, 400/583.3, 188; 101/483, 485, 486, 227, 233, 93, 288; 156/353, 235, 277; 347/43, 105, 4; 229/200; 430/126; 283/81, 91, 101, 109; 252/109, 301.16; 428/195

(56) References Cited

U.S. PATENT DOCUMENTS

| | | | | |
|---|---|---|---|---|
| 2,302,179 | * | 11/1942 | Bronfman | 101/288 |
| 3,869,986 | | 3/1975 | Hubbard . | |
| 3,974,311 | * | 8/1976 | Cherrin | 283/101 |
| 4,488,808 | * | 12/1984 | Kato | 400/708 |
| 4,561,352 | * | 12/1985 | Suyatsky | 101/233 |
| 4,652,330 | * | 3/1987 | Gerband et al. | 101/228 |
| 4,840,696 | * | 6/1989 | Krasuski et al. | 156/353 |
| 4,879,161 | * | 11/1989 | Raymond et al. | 101/486 |
| 4,977,006 | * | 12/1990 | Smith et al. | 156/247 |
| 4,983,487 | * | 1/1991 | Gilreath | 430/126 |
| 5,069,124 | * | 12/1991 | Schneider | 101/483 |
| 5,103,583 | * | 4/1992 | Van Ermen | 283/81 |
| 5,267,754 | * | 12/1993 | Kaule | 101/483 |
| 5,294,946 | * | 3/1994 | Gandy et al. | 101/483 |
| 5,321,436 | | 6/1994 | Herbert . | |
| 5,358,281 | * | 10/1994 | Greig | 283/81 |
| 5,383,731 | * | 1/1995 | Hattorl et al. | 400/708 |
| 5,434,430 | | 7/1995 | Stewart . | |
| 5,466,079 | | 11/1995 | Quintana . | |
| 5,467,709 | * | 11/1995 | Salomon | 101/93 |
| 5,492,061 | * | 2/1996 | Park et al. | 101/486 |
| 5,614,928 | | 3/1997 | Matsuda . | |
| 5,628,574 | * | 5/1997 | Crowley | 101/227 |
| 5,632,511 | * | 5/1997 | Longtin et al. | 283/81 |
| 5,720,499 | * | 2/1998 | Sakashita | 283/81 |
| 5,725,935 | * | 3/1998 | Rajan | 428/195 |
| 5,730,354 | * | 3/1998 | O'Connor | 229/200 |
| 5,795,425 | * | 8/1998 | Brault et al. | 156/235 |
| 5,813,326 | * | 9/1998 | Salomon | 347/4 |
| 5,818,477 | * | 10/1998 | Fullmer | 347/43 |
| 5,899,504 | * | 5/1999 | Fabel | 283/109 |
| 5,932,139 | * | 8/1999 | Oshima et al. | 252/301.16 |
| 6,080,261 | * | 6/2000 | Popat et al | 156/277 |
| 6,085,818 | * | 7/2000 | Takizawa et al. | 156/277 |

FOREIGN PATENT DOCUMENTS

| | | | | |
|---|---|---|---|---|
| 0079691 | * | 4/1986 | (JP) | 400/583.3 |
| 363209859A | * | 8/1988 | (JP) | 400/621 |
| 0021471 | * | 1/1991 | (JP) | 400/188 |
| 0126572 | * | 5/1991 | (JP) | 400/583.3 |

* cited by examiner

*Primary Examiner*—Eugene Eickholt
(74) *Attorney, Agent, or Firm*—James F. McLaughlin; Perman & Green, LLP

(57) ABSTRACT

The invention relates generally to printing bar codes and other indicia on articles, and relates specifically to printing postage on mail pieces by means of ink-jet printing on the adhesive side of transparent adhesive tape.

18 Claims, 2 Drawing Sheets

PRINTING APPARATUS

This application claims priority from provisional application No. 60/019,087 filed Jun. 3, 1996, which application is hereby incorporated herein by reference.

BACKGROUND ART

If one takes into account the many constraints (cost, post office approval, customer requirements, mechanical requirements, human readability) that must be simultaneously satisified, it may fairly be said that it is not easy to print postage. For nearly a hundred years, companies such as Hasler (a predecessor of the assignee of the present invention) and its competitors have provided postage meters which print postage by means of mechanical relief die plates. Generations of mechanical engineers have developed and refined the art of mechanical printing of postage so that today's postage meters (also called franking machines) offer a high-quality die-printed postage indicium together with all the benefits flowing from the use of microprocessors.

It has been recently suggested to use digitally formed indicia instead of die-printed indicia, a move which would discard a substantial fraction of the accumulated experience with die printing of postage and which opens up a host of new problems. The printing technologies most often proposed for digitally formed indicia are ink-jet and laser printing. These technologies have many potential disadvantages. A chief disadvantage is that while it is easy to print on plain paper, on empty envelopes or on conventional labels, it is difficult to print on mail pieces of varying thickness. A further problem is that mail pieces may be constructed from a variety of materials including smooth paper, rough paper, and nonwoven fabrics such as Tyvek, and these materials differ greatly from one to the next in their suitability for laser or ink-jet printing. Another problem comes from the inks commonly used for ink-jet printing. Many such inks are water-soluble and thus are easily smeared or damaged as a mail piece passes through the mail stream.

The hazards faced by a postal indicium that is in the nature of a bar code are of a new and different sort as compared with the hazards faced by a die-printed indicium. With a bar code, especially a two-dimensional bar code as has recently been suggested, the loss of even a small portion of the code can make it difficult or impossible to read the entirety of the code. The problems of printing on varying materials of varying thicknesses exacerbate the risk of loss of a portion of the bar code. Abrasion during shipment, or water damage, can also damage the code. Finally, some materials such as nonabsorbent substrates don't take ink-jet ink well.

Yet another problem with digitally formed postal indicia is that if the indicium turns out to be defective and if the defect is not detected until the mail piece has entered the mail stream, then there will be unwanted consequences such as returning the mail piece to sender or forwarding the mail piece with postage due. One category of risk is that a digital printer such as an ink-jet printer could run low on ink, or develop a clogged jet, leading to an indicium which is not visibly flawed but which might nonetheless fail the cancellation checking by the postal service. Another category is that an indicium might pass a test at the sender's location and yet fail the test at the postal service due to a mechanical assult or water damage, so that a test at the sender's location would not provide complete confidence that the mail peice will not be returned to sender or delivered with postage-due.

There is thus a great need for an apparatus that prints digitally formed postal indicia on mail pieces, that is robust against abrasion and physical assaults, that is resistant to water damage, and that works well with a wide variety of materials and thicknesses. There is also a great need for an apparatus which permits a test of the indicium at the customer location, and which permits a high confidence that a favorable test at the customer location presages a favorable test at the postal service location. Finally there is a need for a means of printing digitally formed indicia on mail pieces that saves "spoiled" mail pieces in the event of a defective indicium.

DISCLOSURE OF THE INVENTION

A printing apparatus is described in which ink-jet printing is performed on the adhesive side of transparent adhesive tape, and lengths of the tape are then applied to articles such as mail pieces. The apparatus permits printing postal indicia on mail pieces. The indicia are physically protected against degradation by the tape, and it is easy to inspect the indicia before they are placed on the mail piece.

BRIEF DESCRIPTION OF DRAWING

The invention will be described in connection with a drawing in several figures, of which.

MODES FOR CARRYING OUT INVENTION

Figure 1:
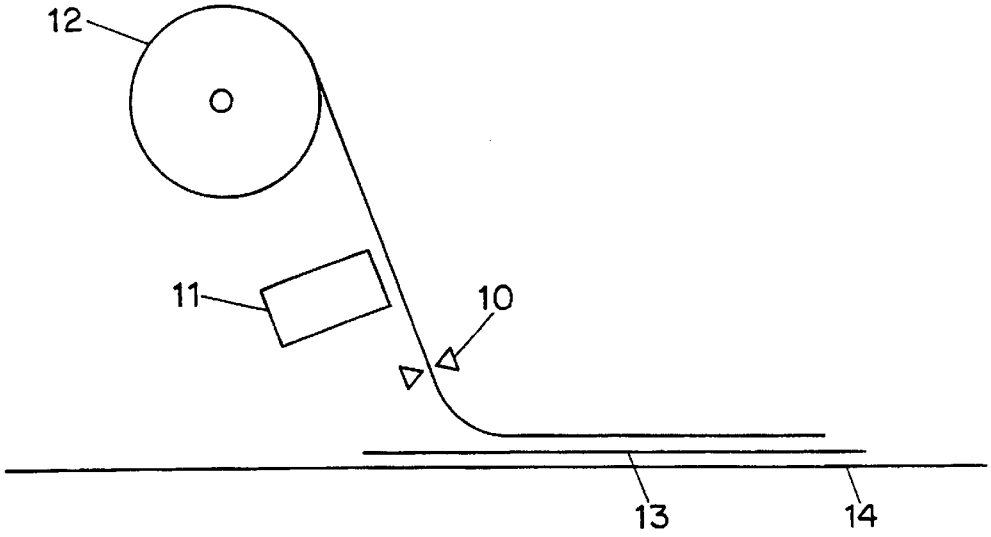
FIG. 1 shows a simple embodiment, in cross section, of a printing apparatus in accordance with the invention.

FIG. 1 shows a simple embodiment, in cross section, of a printing apparatus in accordance with the invention. A surface 14 defines a paper path on which mail pieces 13 pass, from left to right in FIG. 1. The rollers and other mechanisms which move the mail pieces 13 are conventional and are omitted for clarity in FIG. 1. A spool of transparent adhesive tape 12 is provided. An acetate-based tape such as, for example, Scotch Magic Tape (a trademark of 3M) is considered preferable. The tape passes along a tape path defined by the spool 12, a print head 11, and a cutter 10, to the mail piece 13. An applicator mechanism applies the pieces of tape to the mail pieces, by means of conventional mechanism omitted for clarity in FIG. 1. Most importantly, the ink-jet print head 11 is positioned on the adhesive or "sticky" side of the tape. Preferably the tape path is set up relative to the print head so that the spacing between the print head and the tape is nearly constant with the print head and the tape in close juxtaposition but not in physical contact. (Physical contact would present the risk of clogging the print head due to the adhesive of the tape, and would run the risk of mechanical jamming.) Importantly, the image formed on the tape has to be a mirror image of what is desired on the mail piece.

Those skilled in the art will appreciate that most ink-jet print heads need to be capped when not in use, and need to be scraped clean from time to time as part of a cleaning process in which ink is squirted into a well. The cap, the scraper, and the well are all selectively moved into and out of juxtaposition with the print head from time to time as is well known to those skilled in the art, and these movements are accomplished by parts omitted for clarity in FIG. 1.

The print head may optionally be wide enough to print the entire indicium on the tape, or may be passed back and forth across the width of the tape as part of the printing process, in a manner well known to those skilled in the art. Such movement is in and out of the page in FIG. 1.

Printing on an article in this way offers many benefits. The image quality is nearly independent of the substrate (rough paper, smooth paper, etc.). Lack of waterfastness of the ink-jet ink is not as much of a problem since the tape protects the printed area. Any of a variety of other solvents (besides water) which might damage the printed area, are kept away from the printed area by the tape. Even a nonabsorbent substrate, for example a nonwoven polyolefin fabric such as Tyvek (a registered trademark), can be easily printed upon with an image quality that is unaffected by the nonabsorbent nature of the substrate.

Figure 2:
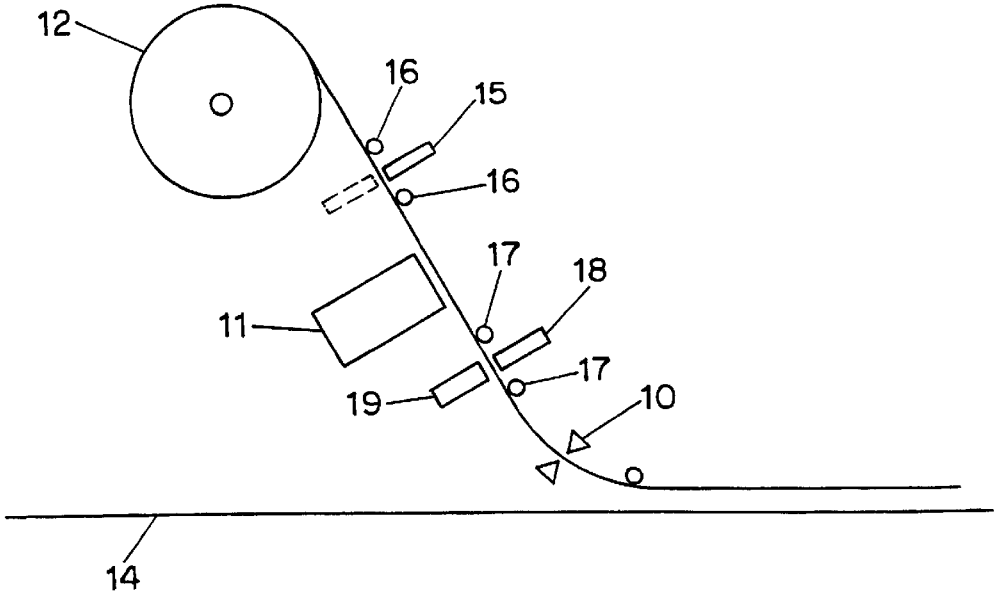
FIG. 2 shows an alternative embodiment of the invention, also in cross section.

FIG. 2 shows an alternative embodiment of the invention, also in cross section. In this embodiment a physical sensor 15 is provided movable between two positions. It is biased into the leftward position shown in phantom in FIG. 2, and is held by the tape in the rightward position in FIG. 2. In this way, if the tape ends the event will be detectable and can be annunciated to a user. Also shown in FIG. 2 is an ink sensor 18-19, composed of light source 19 and phototransistor array 18. It is considered preferable for the tape path to maintain some tension in the tape, so that the tape is held against the out-of-tape sensor 15, is held in a fixed position relative to the print head 11, and is held against the phototransistor array 18. In this way, the non-adhesive side of the tape is the side in moving contact with most of the contact portions of the tape path, and the adhesive side of the tape is kept out of physical contact with as many portions of the tape path as possible.

The ink sensor 18-19 can be a simple sensor that merely tests for presence and absence of ink, for example testing for large light and dark areas in a test pattern printed on the tape. In this way if the ink jet print head runs out of ink the user can be notified. Alternatively the sensor 18-19 may be disposed to read the entirety of a bar code of the postal indicia. This permits reaching a very high confidence level that the bar code will be readable when tested by the postal authorities, since it is unlikely to be mechanically abraded or water-damaged after being applied to the envelope. If the bar code fails the test at the user location, the tape piece can be discarded prior to its being applied to a mail piece, thereby saving "spoiled" mail pieces in the event of a defective indicium.

Figure 3:
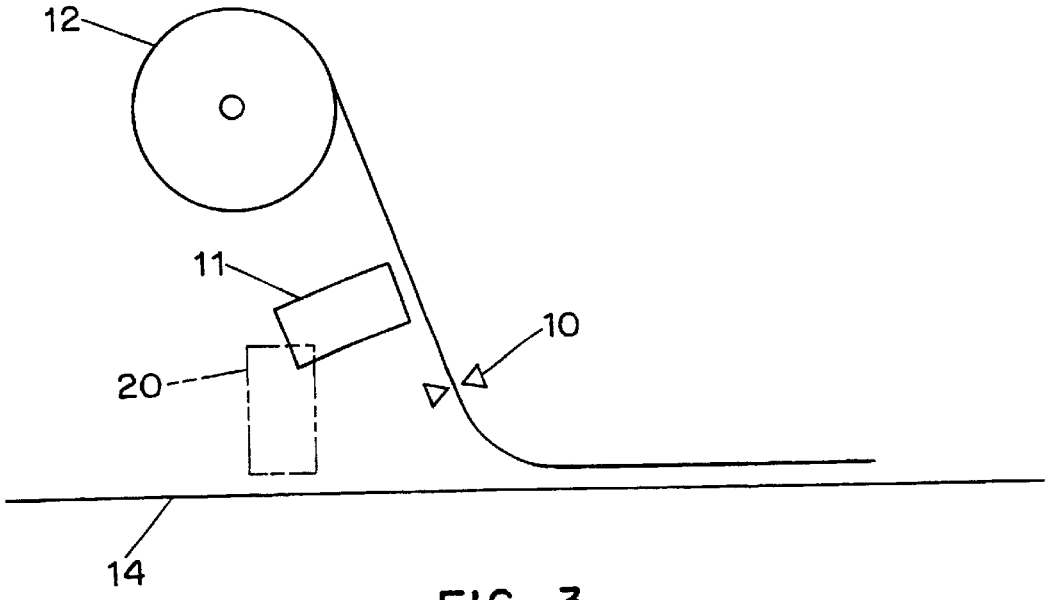
FIG. 3 shows another embodiment of the invention, also in cross section.

FIG. 3 shows another embodiment of the invention, also in cross section. FIG. 3 shows an optional arrangement in which the print head shown at 11 is optionally rotatable to a second position 20 in which it can print directly on mail pieces. This rotation may be manual or automatic, and offers the flexibility of direct printing on mail pieces or of printing via tape to the mail pieces.

Figure 4:
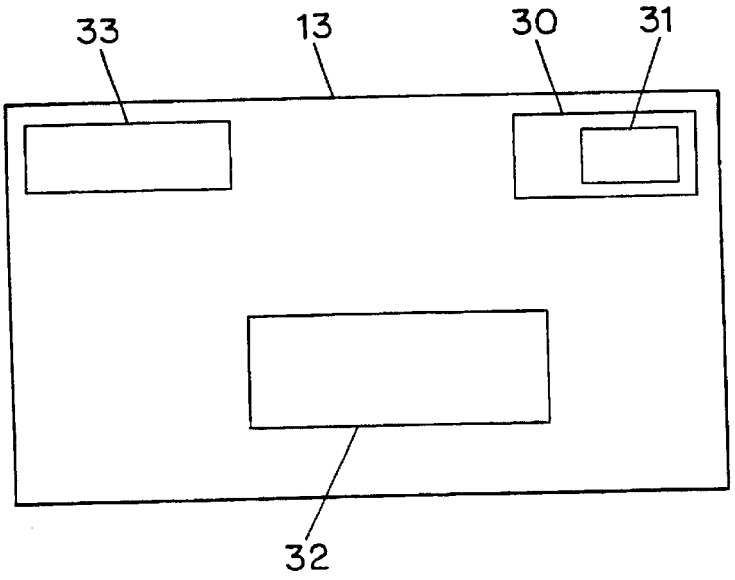
FIG. 4 shows in plan view a typical mail piece in accordance with the invention.

FIG. 4 shows in plan view a typical mail piece 13 in accordance with the invention. A return address 33 and a mailing address 32 are shown. A portion of clear adhesive tape 30 has been placed on the mail piece 13. A postal indicium 31 was printed on the adhesive side of the tape 30 prior to the tape 30 being applied to the mail piece 13.

What is claimed is:

1. A postage printing apparatus comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is adapted to print postage indicia on said adhesive side of said tape; and further comprising, in the tape path between the spool and the head, a mechanical sensor movable between first and second positions and biased toward said second position, said mechanical sensor urged into said first position when tape is in the tape path.

2. The apparatus of claim 1 further comprising a surface defining a paper path, said tape path after passing said head intersecting said paper path with the adhesive side of the tape toward said paper path, wherein the adhesive side of the tape is capable of contacting an item in the paper path.

3. A printing apparatus comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is capable of printing on said adhesive side of said tape, and further comprising, in the tape path between the head and the cutter, an optical sensor, said optical sensor disposed to sense ink on the tape.

4. The apparatus of claim 3 wherein the optical sensor comprises a plurality of light sensors, said sensors disposed on the non-adhesive side of the tape.

5. The apparatus of claim 4 wherein the light sensors are phototransistors, and wherein the optical sensor further comprises at least one light-emitting diode.

6. A postage printer comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is adapted to print postage indicia on said adhesive side of said tape, said printer further comprising a surface defining a paper path, said tape path after passing said head intersecting said paper path with the adhesive side of the tape toward said paper path, wherein the adhesive side of the tape is capable of contacting a mail piece in the paper path to locate the printed postage indicia between the mail piece and the tape; and further comprising, in the tape path between the spool and the head, a mechanical sensor movable between first and second positions and biased toward said second position, said mechanical sensor urged into said first position when tape is in the tape path.

7. A postage printer comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is capable of printing on said adhesive side of said tape, said printer further comprising a surface defining a paper path, said tape path after passing said head intersecting said paper path with the adhesive side of the tape toward said paper path, wherein the adhesive side of tape is capable of contacting a mail piece in the paper path, and further comprising, in the tape path between the head and the cutter, an optical sensor, said optical sensor disposed to sense ink on the tape.

8. The apparatus of claim 7 wherein the optical sensor comprises a plurality of light sensors, said sensors disposed on the non-adhesive side of the tape.

9. The apparatus of claim 8 wherein the light sensors are phototransistors, and wherein the optical sensor further comprises at least one light-emitting diode.

10. A method of applying a postal bar code to a mail piece, said method comprising the steps of:

feeding adhesive transparent tape from a spool, said tape having an adhesive side and a non-adhesive side;

printing the postal bar code on the adhesive side of the tape by means of noncontact printing;

applying the adhesive side of the tape to the mail piece to locate the postal bar code between the mail piece and the tape; and further comprising the step of testing the quality of the bar code printed inside a useable printing area of said tape by means of an optical sensor, prior to the step of applying the tape to the article.

11. The method of claim 10 further comprising the step of cutting the tape.

12. The method of claim 10 wherein the step of applying comprises the tape feeding along a tape path into a paper path and being applied directly to the article with the printed bar code being sandwiched directly between the article and the tape.

13. The method of claim 10 wherein the step of printing prints the bar code as a mirror image of a postal bar code indicium.

14. A method of applying a bar code to an article, said method comprising the steps of:

feeding adhesive transparent tape from a spool, said tape having an adhesive side and a non-adhesive side;

printing a bar code on the adhesive side of the tape by means of noncontact printing;

applying the tape to the article; and testing for ink on the tape by means of an optical sensor, prior to the step of applying the tape to the article.

15. The method of claim 14 wherein the testing step further comprises reading the bar code.

16. The method of claim 15 further comprising the step of annunciating to a user if the bar code is unreadable.

17. A postage printing apparatus comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is adapted to print postage indicia on said adhesive side of said tape; and further comprising, in the tape path between the head and the cutter, an optical sensor, said optical sensor disposed to test the quality of printing inside a useable printing area of said tape.

18. A postage printing apparatus comprising: a spool of adhesive transparent tape, an ink-jet print head, and a cutter, said spool, head, and cutter defining a tape path for said tape, said tape having an adhesive side and a non-adhesive side, said head positioned toward said adhesive side of said tape, wherein said head is adapted to print postage indicia on said adhesive side of said tape; and wherein said print head is rotatable between a first position facing towards said adhesive side of said tape and a second position facing towards said surface defining said paper path.

* * * * *